United States Patent [19]

Steimle

[11] 4,406,026

[45] Sep. 27, 1983

[54] POOL OR SPA SWEEP JET HEAD ATTACHMENTS

[76] Inventor: Wayne D. Steimle, 2085 Vista Ave., Arcadia, Calif. 91006

[21] Appl. No.: 415,149

[22] Filed: Sep. 7, 1982

[51] Int. Cl.[3] ..... E04H 3/16; E04H 3/18

[52] U.S. Cl. ..... 4/492; 4/496; 81/3 R; 81/90 C; 81/90 D; 81/177 A

[58] Field of Search ..... 239/203, 204, 205, 206; 81/90 R, 90 C, 90 D, 90 B, 177 R, 177 A, 177 UJ; 4/490, 496, 492, 507

[56] References Cited

U.S. PATENT DOCUMENTS

| | | | |
|---|---|---|---|
| 2,397,574 | 4/1946 | Thonet | 81/90 C |
| 2,985,242 | 5/1961 | Papa | 81/90 R |
| 3,545,066 | 12/1970 | Stillman et al. | 81/3 R |
| 3,577,571 | 5/1971 | Bellinson et al. | 4/492 |
| 3,821,975 | 7/1974 | Haker | 81/90 C X |
| 4,065,941 | 1/1978 | Aoki | 81/177 UJ X |
| 4,075,913 | 2/1978 | Tye | 81/177 UJ |
| 4,148,234 | 4/1979 | Steimle | 81/3 R |
| 4,334,443 | 6/1982 | Pearson | 81/90 R X |

*Primary Examiner*—Henry K. Artis

*Attorney, Agent, or Firm*—William W. Haefliger

[57] ABSTRACT

An improvement is provided for combination with a pool jet head receptacle attachable to pool wall structure, the receptacle having an open top, an open bottom, and an internal thread. The improvement comprises:

(a) an attachment in the form of a body receivable downwardly into the receptacle, (b) external threading on the body to rotatably attach to the receptacle thread, (c) a head on the body to close the receptacle open top, (d) and manipulable structure on the top of the head, that structure taking one of several forms.

18 Claims, 9 Drawing Figures

POOL OR SPA SWEEP JET HEAD ATTACHMENTS

BACKGROUND OF THE INVENTION

This invention relates generally to servicing of pools or spas; and more particularly concerns attachments removably receivable in receptacles installed in the wall of a pool or spa.

U.S. Pat. No. 4,148,234 discloses a tool kit useful for servicing turbo heads. Such a kit includes a handle and a pair of tools attachable thereto, and by which a workman on the pool deck may gain access to and service a turbo head in the pool. (The head itself is disclosed in U.S. Pat. No. 3,506,489). The service tool includes a spring clip to engage with water passages at the turbo head, such engagement at times being difficult to effect, from a remote location. Also, no suitable way was known to provide closure of the space occupied by the turbo head, after its removal; and no attachments in accordance with the present invention were provided.

SUMMARY OF THE INVENTION

It is a major object of the invention to provide an improved attachment adapted for ready combination with a pool jet head receptacle installed in a pool wall, the attachment also having various forms to provide different functions. Such functions for example include jet sweeping of debris adjacent the pool wall, optional closure of the receptacle, and optional provision of a fountain at the pool water surface. The receptacle for the attachment or attachments typically has an open top, an open bottom, and an internal thread. The basic attachment, then, comprises (a) an attachment in the form of a body receivable downwardly into said receptacle, (b) external threading on the body to rotatably attach to the receptacle thread, (c) a head on the body to close the receptacle open top;

(d) and manipulable means on the top of the head.

As will be seen, in its receptacle closing form, the attachment has a tool such as a nut integral with a head on the attachment, and which is rotatable to unscrew the attachment body from the receptacle. That head may have an annular rim which is beveled to provide a near flush closure at the top of the receptacle.

In another form, the attachment may include a tubular duct communicating through the attachment body and head for upward jetting of a pressurized water stream, to form a fountain at the pool surface. A ball and socket connection of the duct to the head may afford adjustable tilting of the duct to control the fountain location.

In yet another form, the attachment may incorporate a head having a side port for discharge jetting of a stream of water adjacent the pool wall, for cleaning purposes, when the head is in temporarily elevated position, as will be described. The head also has shoulders defined by openings in the top thereof to receive claw tangs of a tool manipulable from the pool deck, for rotatably installing the attachment into the receptacle, and for reverse rotatably removing the attachment from the receptacle, as will appear.

These and other objects and advantages of the invention, as well as the details of an illustrative embodiment, will be more fully understood from the following specification and drawings, in which:

DRAWING DESCRIPTION

FIG. 1 is an elevation, in section, showing one form of a device incorporating the invention, including a receptacle and one form of attachment thereto;

FIG. 1*a* is a fragmentary section taken on lines 1*a*—1*a* of FIG. 1;

Figure 1:
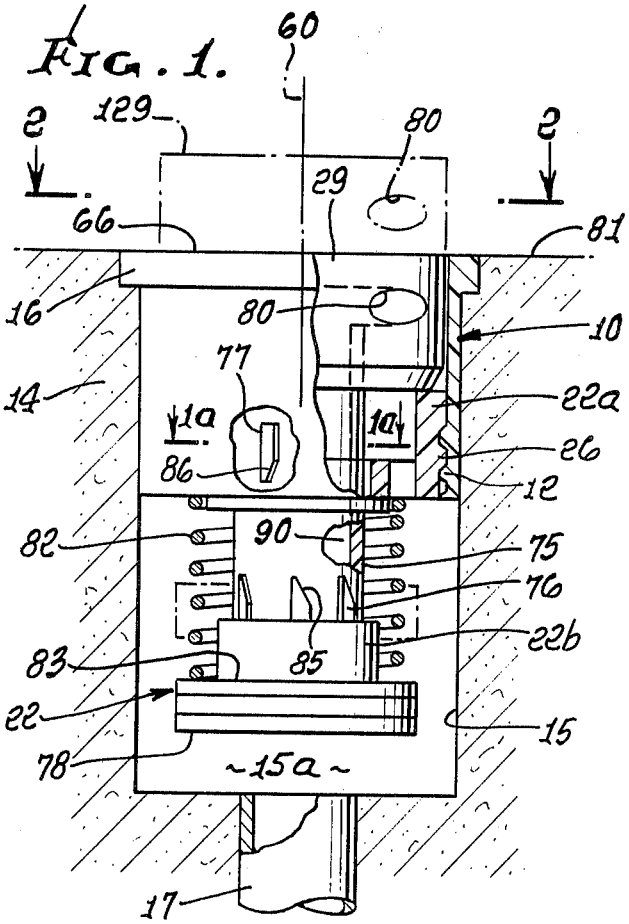
Figure 3:
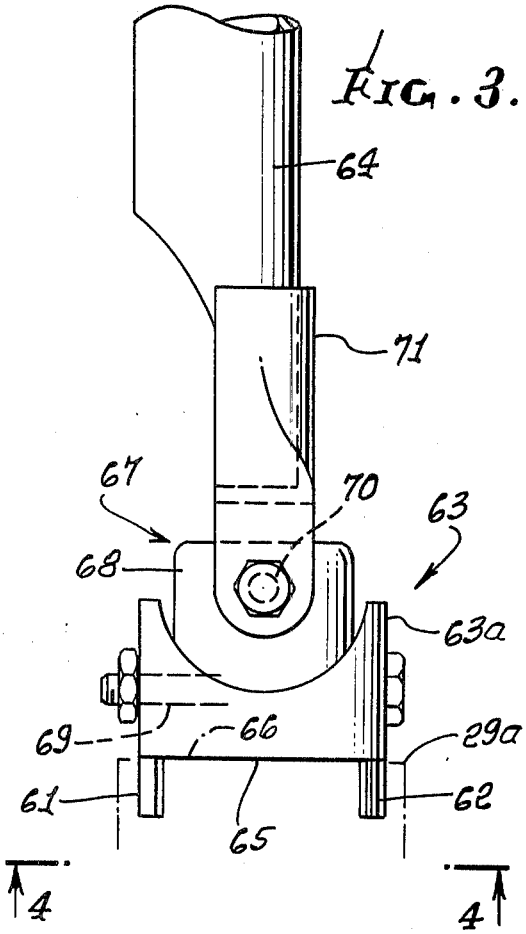
FIG. 3 is an elevation showing a remotely manipulable tool usable in combination with the FIG. 1 device.
Figure 4A:
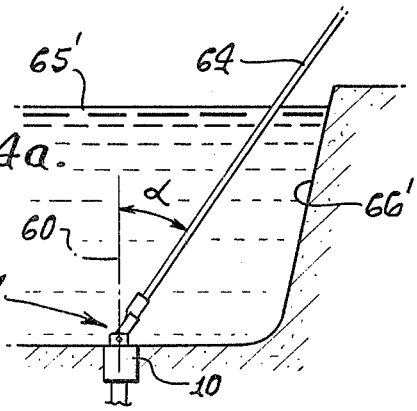
Figure 5:
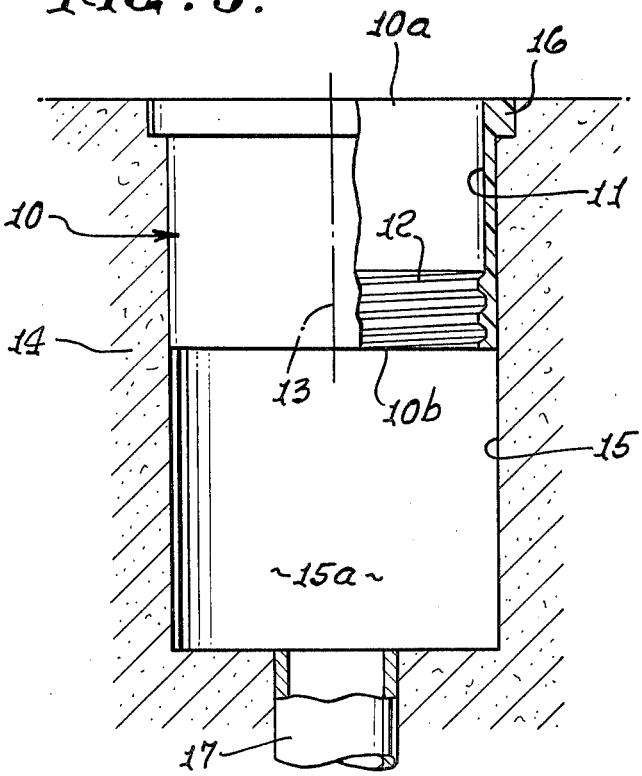
Figure 6:
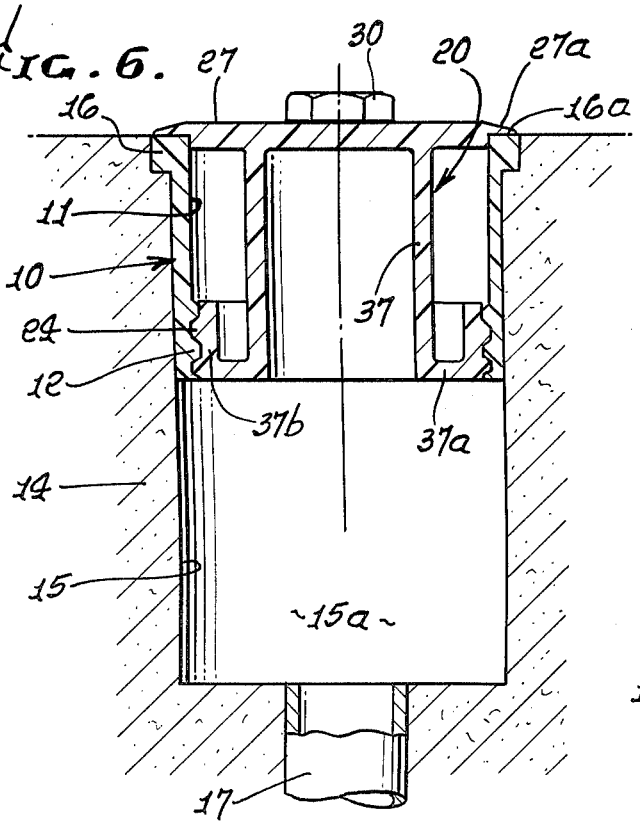
Figure 7:
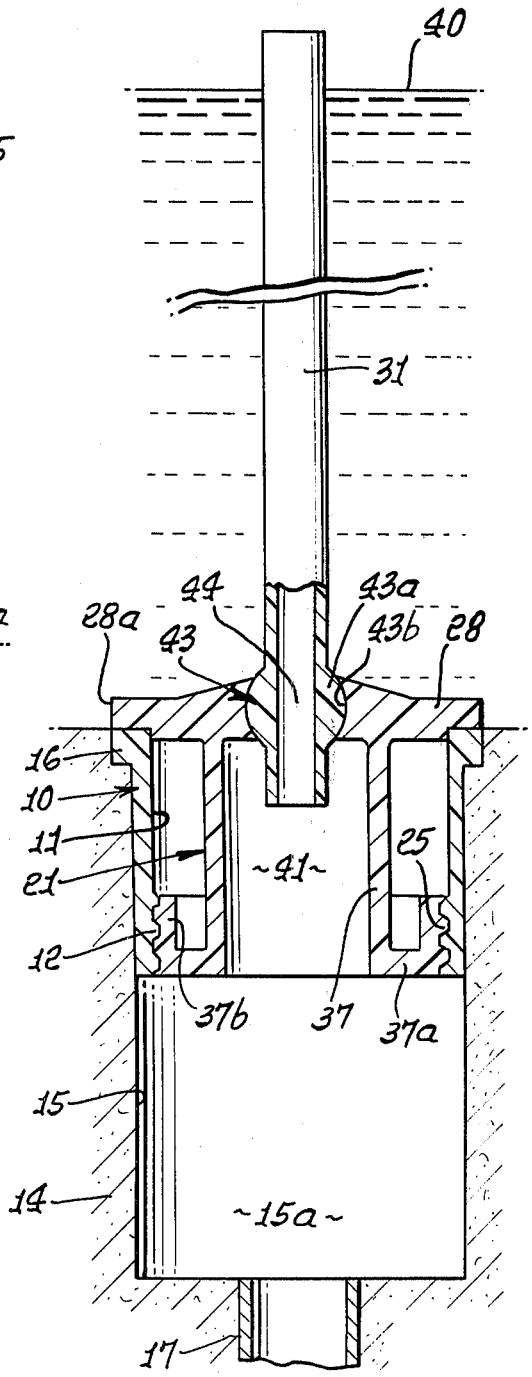

FIG. 4*a* is a fragmentary elevation showing the tool of FIG. 3 in a pool, with its long handle projecting at pool side;

FIG. 5 is a view like FIG. 1, showing a receptacle adapted to receive various attachments in accordance with the invention;

FIG. 6 is a view like FIG. 5 showing the receptacle, and another attachment;

FIG. 7 is a view like FIG. 5, showing the receptacle and yet another attachment.

DETAILED DESCRIPTION

In FIGS. 1 and 5–7, the receptacle 10 is attachable to pool wall structure, and has an open top 10*a*, an open bottom 10*b*, a bore 11, and an internal thead 12 proximate bottom 10*b*. Thread 12 extends about a central axis 13 defined by the receptacle, which may consist of molded plastic material. The receptacle is illustrated as attached to pool wall structure 14 defining a cylindrical recess 15 into which the receptacle is received. Flange 16 limits downward insertion of the receptacle into the recess. Water under pressure is delivered via duct 17 to the interior 15*a* of the recess and thus to the open bottom of the receptacle.

Figure 2:
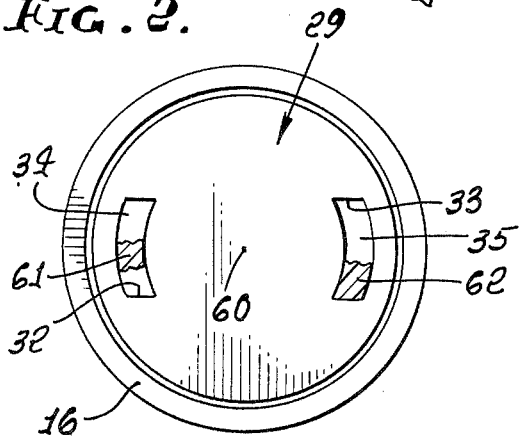
FIG. 2 is a top plan view on lines 2—2 of FIG. 1.

The various attachments (to the receptacle) shown in the drawings have the following elements:

(a) a body receivable downwardly into the recess (see body 20 in FIG. 6, body 21 in FIG. 7, and body 22 having sections 22*a* and 22*b* in FIG. 1);

(b) external threading on the body to rotatably attach to the receptacle thread (see body thread 24 in FIG. 6, thread 25 in FIG. 27, and thead 26 on one body section 22*a* in FIG. 1);

(c) a head on the body to close the receptacle open top (see head 27 in FIG. 6, head 28 in FIG. 7, and head 29 integral with the other body section 22*b* in FIG. 1);

(d) manipulable means at the top of the head (see the nut 30 integral with the head 28 in FIG. 6, duct 31 in FIG. 7) and shoulders 32 and 33 defined by openings 34 and 35 recessed into the top of head 29, in FIG. 2, as at opposite sides of vertical axis 60).

Referring again to FIG. 6, the nut 30 is typically integral with the head 27, which is in the form of a cap integral with body cylindrical wall 37 spaced radially inwardly from bore 11. Wall 37 is reversely turned at annular region 37*a* to mount or define thread 24 on wall section 37*b*, this same wall construction also appearing in FIG. 7. Head or cap 27 in FIG. 6 extends transversely, and has a beveled annular rim 27*a* seating and sealing downwardly on the top rim 16*a* of the receptacle. When the nut is turned, the body is rotated to unthreadably disconnect from the receptacle, so that other type attachments may be inserted into the receptacle.

In FIG. 7, the head or cap 28 has a fluted outer annular edge at 28*a* adapted to be grasped and rotated, to connect the body into the receptacle, or remove the body from the receptacle, via the threaded connection as at 12 and 25. Tube 31 is shown extending to the top surface 40 of the pool or spa, to deliver water under pressure from the interior 15*a* of the recess as well as the hollow interior 41 of the body with which the tube communicates. A ball and socket connection of the tube to the head is shown at 43, and includes ball 43*a* and spherical socket 43*b*. The ball contains a through passage 44 to pass water to the tube. That connection allows limited tilting (i.e. manipulation) of the tube in different directions, for different fountain effects.

Referring to FIGS. 1–4 the openings 34 and 35 in and at the top of the head 29 are adapted to be downwardly penetrated by two tangs 61 and 62 integral with a claw 63 having a body 63*a* from which the tangs project downwardly. FIG. 3 shows this condition, with the head 29 illustrated by broken line 29*a*, and the claw flat bottom surface 65 engaging the top flat surface 66 of the head. See also FIG. 2 with an arcuate tang 61 received in arcuate opening 34, and an arcuate tang 62 received in arcuate opening 35 with light frictional interfit, whereby the tangs tend to hold the claw attached to the head 29 until forcibly pulled upwardly by the claw. To this end, the tangs may be slightly downwardly tapered. When the tangs are so inserted in the openings 34 and 35, and the claw rotated (clockwise for example, looking downwardly), the heat 29 and body portions 22*a* and 22*b* of the attachment are rotated to the right, freeing these elements for removal as a unit from the receptacle, as by unscrewing thread 26 from thread 12. Alternatively, when these elements are to be replaced into the receptacle, the claw is manipulated to insert sections 22*a* and 22*b* downwardly into the receptacle (as by maneuvering long handle 64 attached to the claw), and then rotated counterclockwise to make up threads 26 and 12. Note in FIG. 4*a*, the long handle 64 projecting upwardly from the pool water 65', and above the side 66' of the pool for the convenience of the user.

A universal joint 67 interconnects the claw body 63*a* and the handle 64, as shown in FIG. 3. That joint may for example include a coupling part 68, transverse pin 69 interconnecting part 68 to claw body 63*a*, and transverse pin 70 interconnecting part 68 with an adapter 71 on the lower end of the handle. Since pins 69 and 70 extend mutually orthogonally, a universal joint is provided, allowing handle 64 to extend at a variable angle $\alpha$ from axis 60, and over the pool deck to be rotated at the convenience of the user. This allows ease of removal of the water jetting attachment from the receptacle 10, and its cleaning and replacement.

Figure 1A:
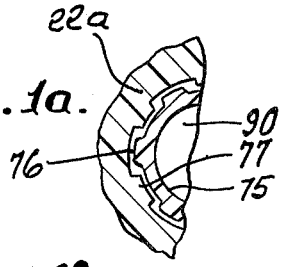
Figure 4:
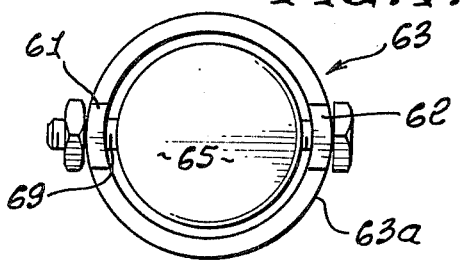
FIG. 4 is a bottom plan view on lines 4—4 of FIG. 3.

As noted, the body section 22*a* carries thread 26, whereas body section 22*b* carries head 29. Section 22*b* has axial slip fit and splined connection with section 22*a*, as shown in FIG. 1*a*. Thus, section 22*b* tubular stem 75 has axial splines 76 meshing with axial splines 77 on tubular section 22*a*. As section 22*b* is displaced upwardly in response to water pressure exertion on lower piston face 78, the head 29 is pushed to up-position indicated by broken lines 129, in FIG. 1. This allows pressurized water jet discharge via jet opening 80, generally parallel to and near the wall 81 of the pool, sweeping debris into the pool water for subsequent pool filter removal from the water.

Since pressure against piston bottom face 78 simultaneously reduces, spring 82 then urges and displaces section 22*b* downwardly to full-line position (the spring bearing against piston surface 83, and underside of body section 22*a*).

On the upstroke and downstroke of the section 22*b*, upper cams 85 on splines 76, and lower spline cams 86 on stem 75, engage the splines 77, and consequently are displaced by splines 77 to rotatably index the section 22*b* through a small angle about axis 60, whereby the water jet discharged from port 80 sweeps a different path each time the head 29 is elevated.

Porting 90 in the section 22*b* passes pressurized water to the head to discharge from the port 80.

All the described attachments as well as the claw of FIG. 3 may consist of molded plastic material.

I claim:

1. In combination with a pool jet head receptacle attachable to pool wall structure, the receptacle having a bore, an open top, an open bottom, and an internal thread, the improvement comprising (a) an attachment in the form of a body having a tubular wall receivable downwardly into said receptacle, said wall spaced inwardly from said receptacle bore, (b) external threading on an annular return bend surface defined by the body outwardly of said wall to rotatably attach to the receptacle thread, (c) a head on the body to close the receptacle open top; said head engaging the top of the receptacle to limit said body downward reception into the receptacle, (d) and manipulable means on the top of the head, including spaced shoulders adapted to be engaged by a rotary tool operable to unscrew the body from the receptacle.

2. The improvement of claim 1 wherein said receptacle is attached to pool wall structure to expose said means on the body to the pool interior adapted to receive water.

3. The improvement of claim 1 wherein said (d) means comprises a nut integral with the body and rotatable to unscrew the body from the receptacle.

4. For combination with a pool jet head receptacle attachable to pool wall structure, the receptacle having an open top, an open bottom, and an internal thread, the improvement comprising (a) an attachment in the form of a body receivable downwardly into said receptacle, (b) external threading on the body to rotatably attach to the receptacle thread, (c) a head on the body to close the receptacle open top;

(d) and manipulable means on the top of the head comprising a tubular duct communicating through said body for upward jetting of a pressurized water stream to form a fountain.

5. The improvement of claim 4 including a ball and socket connection between said duct and said body, the ball forming a through passage in communication with a bore formed by the duct.

6. The improvement of claim 4 including said receptacle to which the body is threadably attached, said receptacle in turn being attached to the pool wall structure to direct said duct in the pool interior toward the surface of water filling the pool, to provide a fountain.

7. The improvement of claim 1 wherein the body has porting therein to jet water adjacent pool wall structure.

8. The improvement of claim 7 wherein said porting has a jet outlet at the side of the head.

9. The improvement of claim 8 wherein said shoulders are defined by openings in the head spaced apart about an axis defined by the body.

10. The improvement of claim 9 including said tool in the form of a claw having tangs removably received into said openings.

11. The improvement of claim 10 wherein the tool includes a universal joint attached to the claw, the joint also connected with an elongated handle which is maneuverable from above the pool or spa to insert the claw tangs into said openings, for then rotating the claw and body to retrieve the body from the receptacle.

12. The improvement of claim 10 wherein the tangs have frictional interfit with shoulders defined by the openings.

13. The improvement of claim 9 wherein the openings are diametrically spaced apart relative to said axis.

14. For combination with a pool jet head receptacle attachable to pool wall structure, the receptacle having an open top, an open bottom, and an internal thread, the improvement comprising (a) an attachment in the form of a body receivable downwardly into said receptacle, (b) external threading on the body to rotatably attach to the receptacle thread, (c) a head on the body to close the receptacle open top, (d) and manipulable means on the top of the head, (e) the body having porting therein to jet water adjacent pool wall structure, said porting having a jet outlet at the side of the head, (f) said manipulable means including spaced shoulders adapted to be engaged by a rotary tool operable to unscrew the body from the receptacle, said shoulders defined by openings in the head spaced apart about an axis defined by the body, (g) the body including two sections one of which carries said thread, and the other of which carries said head, said other section movable axially in a first direction relative to the one section in response to water pressure exertion to expose said jet outlet to the pool wall structure, and return spring means to thereafter move said other section in a second and opposite direction carrying said jet opening into the receptacle.

15. The improvement of claim 14 including indexing means on said sections to rotatably index said other section relative to said one section in response to said other section movement.

16. The combination of claim 1 wherein said spaced shoulders are defined by openings in the head, and including:

(e) a claw having two tangs that interfit downwardly into said openings, (f) and a universal joint attached to the claw, the joint connectible with an elongated handle which is maneuverable from above the pool or spa to insert the claw tangs into said openings, for then rotating the claw body to retract the body from said receptacle.

17. The improvement of claim 16 wherein the tangs have frictional interfit with said shoulders defined by the openings.

18. The improvement of claim 15 wherein the claw tangs are diametrically spaced apart relative to a central axis defined by the claw.

* * * * *